United States Patent [19]

Johnson

[11] Patent Number: 5,072,932

[45] Date of Patent: Dec. 17, 1991

[54] EXERCISE APPARATUS

[76] Inventor: John B. Johnson, 2090 Larkin Ave., Elgin, Ill. 60123

[21] Appl. No.: 661,392

[22] Filed: Feb. 26, 1991

[51] Int. Cl.[5] ..... A63B 21/00

[52] U.S. Cl. ..... 272/116; 272/136; 272/134; 272/130

[58] Field of Search ..... 272/136, 116, 143, 134, 272/63, 67, 135, 130, 141, 138, 142, 66

[56] References Cited

U.S. PATENT DOCUMENTS

| | | | |
|---|---|---|---|
| 198,672 | 7/1964 | Anthony | 272/66 |
| 2,764,132 | 2/1954 | Wisner | 272/166 |
| 3,128,094 | 4/1964 | Wolf | 272/134 |
| 4,241,913 | 12/1980 | Zwayer | 272/134 |
| 4,357,010 | 11/1982 | Telle | 272/130 |
| 4,647,041 | 3/1987 | Whiteley | 272/130 |
| 4,709,923 | 12/1987 | Gibson | 272/134 |

FOREIGN PATENT DOCUMENTS

| | | | |
|---|---|---|---|
| 0079028 | 5/1983 | European Pat. Off. | 272/136 |
| 566619 | 12/1932 | Fed. Rep. of Germany | 272/116 |
| 2593071 | 7/1987 | France | 272/130 |

*Primary Examiner*—Richard J. Apley
*Assistant Examiner*—Jerome Donnelly
*Attorney, Agent, or Firm*—Kajane McManus

[57] ABSTRACT

The exercise apparatus includes a rectangular base member and a horizontal planar top member situated thereabove. The top member is engaged to a horizontally pivotable head portion of a telescoping, vertical support member which extends upwardly from the base member and includes on the top telescoping portion a radial flange extending laterally outwardly therefrom in an area beneath the horizontal top member. The horizontal top member includes a slidable planar element engaged thereto which seats against one end of a tensioning spring engaged therebeneath, the other end of the spring being slidably engaged to the radial flange.

11 Claims, 2 Drawing Sheets

EXERCISE APPARATUS

BACKGROUND OF THE INVENTION

The present invention relates to a gravity assisted resistance exercise apparatus by means of which a user may exercise the abdominal muscles and to a lesser degree, lower back muscles, for toning and strengthening same.

PRIOR ART

Various gravity assisted exercise apparatus of the passive resistance type for various areas of the body are known.

For example, the Michaels U.S. Pat. No. 4,754,964 discloses an arm wrestling training machine including an elongated, longitudinally-extending supporting frame suitable for placement on a table top and a mechanical wrestling arm assembly pivotally affixed at its lower end to the supporting frame and bearing at its upper end a handgrip member. The arm assembly is rotatable between a substantially horizontal position adjacent the frame and a substantially vertical position and is provided with a force-biasing mechanism which applies a pivotal resistive force to the arm assembly, tending to maintain the arm assembly in its vertical position.

The Mojden U.S. Pat. No. 4,620,701 discloses an adjustable exercise apparatus which includes a pair of elongated handle members. The handles extend, in cantilevered fashion, from a support bar which is disposed substantially horizontally and connected to a vertical pillar by a vertical angle adjusting arrangement and the pillar is mounted upon a stationary base. The vertical angle adjusting arrangement permits the horizontal bar and connected handles to be adjusted into any one of a plurality of mutually parallel positions angularly spaced apart from one another in respective vertical planes.

The Crisp, Jr. U.S. Pat. No. 4,351,527 discloses a double acting exerciser having a tubular body, a first compressible resilient member disposed within the tubular body and prevented from passing from the first end thereof by a holding member, a rod member having an abutting member on its first end which abuts against the first end of the first resilient member, the second end of the first resilient member abutting against the holding member, the rod member having a second resilient member about it, having a cap member for the second end of the tubular body about it and also affixed to the second end of the body member, the rod member having a handle member affixed at or near its second end and the tubular body having a second handle member affixed at or near its first end. In a presently preferred mode, the tubular body has a base member fixable to it first end.

The Johnson U.S. Pat. No. 3,784,195 discloses a push-pull exerciser with spring resistance and comprises a hollow cylinder having a heavy coil spring loosely positioned therein. A rod passes through the center of the spring to the bottom of the cylinder. A cross bar is mounted on the bottom of the rod and engages the bottom end of the spring. A hollow rod is telescopically slidable at the upper end of the rod. A cross bar is mounted at the bottom end of the hollow rod and engages the top end of the spring. Above the hollow rod, the rod is provided with a vertical slot. A transverse handle is provided with a pin extending through the slot to permit vertical sliding movement of the handle along the rod. On downward movement, the handle engages the top of the hollow rod and pushes the rod and its cross bar down against the top of the spring. This movement can continue until the handle reaches the bottom of the slot. On upward movement of the handle, it engages the upper end of the slot and pulls the rod upwardly so that its cross bar is pulled against the bottom end of the spring. Both ends of the cylinder are closed to limit the movement of the spring. When the bottom of the cylinder is pivotally mounted on a floor or base, movement of the handle up and down provides an excellent exercise for the arms, shoulders and upper back. To heighten the effect, a small platform may be mounted on springs in front of the apparatus. The person stands on the platform and operates the cylinder to provide the body with a sway effect.

The Drakulich U.S. Pat. No. 3,471,146 discloses an exercising apparatus having a normally horizontal lever movable upward against spring resistance. A secondary frame is mounted for vertical adjustment on three vertical frame members arranged in a triangle on a base. A lever is pivoted on the secondary frame close to one of the vertical members and extends between the other two. The secondary frame has a horizontal cross piece below the lever, and coil springs connected between the cross piece and the lever. A stop on the secondary frame engages the lever to prevent it from moving downward below a horizontal position.

As will be described in greater detail hereinafter, the exercise apparatus of the present invention includes a gravity assisted resistive horizontal top member which can be lowered by applying pressure thereon, the lowering being gravity assisted against the adjustable action of a spring biased against an underside of the horizontal top member. The horizontal top member is adjustable with respect to its height above a base member of the apparatus.

Further, the horizontal top member is pivotable about its vertical support arm so that a user can obtain a torque action as well as a lateral action about the midline, specifically for toning the lateral abdominal muscles.

DESCRIPTION OF THE PREFERRED EMBODIMENT

Figure 1:
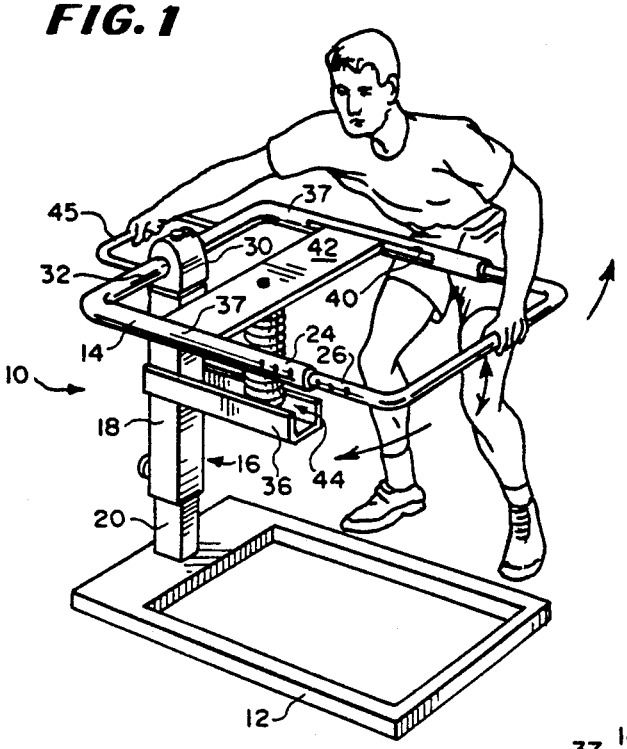
FIG. 1 is a perspective view of the apparatus of the present invention showing same in use toning of the lateral abdominal muscles.
Figure 2:
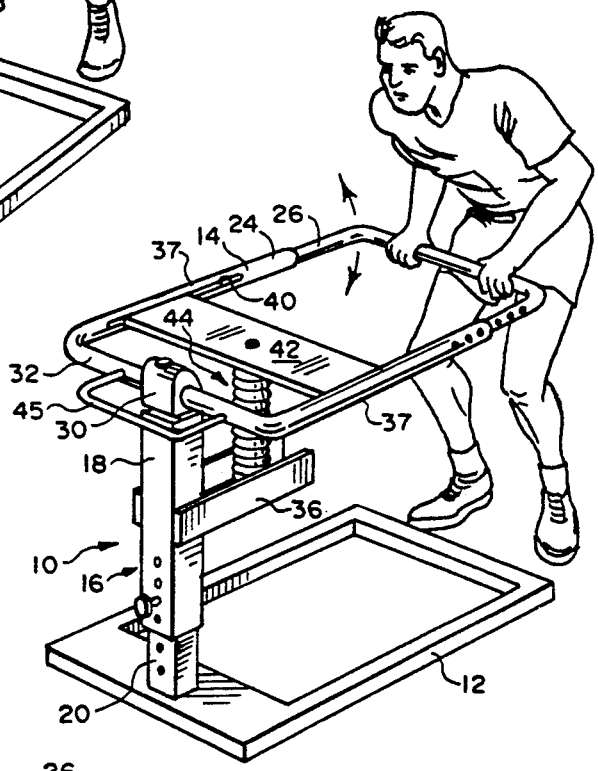
FIG. 2 is another perspective view of the apparatus showing same in use in toning medial abdominal and, to a lesser degree, the lower back muscles.

Referring now to the drawings in greater detail there is illustrated therein the exercise apparatus 10 made in accordance with the teachings of the present invention.

As shown, the apparatus 10 includes a planar base member 12 and a planar horizontal top member 14 which is elevated above the base member 12 by a vertical support 16. The support 16 comprises two telescoping sections 18 and 20 which can be adjusted relative to one another to accommodate the height of the user.

The top member 14 is secured to an upper section 18 of the support 16 in pivotable manner to allow the top member 14 to pivot below the horizontal at the point of engagement to the upper section 18. The top member 14 is a rectangular member formed from two engageable U shaped elements 24 and 26, the free ends of the elements 24 and 26 being sized and configured to slidably engage within one another.

The upper section 18 of the vertical support 16 includes a pivotable head 30 thereon to which a base portion 32 of one of the U shaped elements 24 is engaged. In this manner, the top member 14 is made pivotable in the horizontal plane as well as in the vertical.

The upper section 18 of the vertical support 16 further includes a flange member 36 extending radially outwardly therefrom in an inwardly directed manner positioned between the horizontal top member 14 and the base member 12. The flange member 36 extends a distance approximately two thirds the length of the legs 37 of the U shaped member 24 engaged to the pivotable head 30 of the vertical support 16. Each of the legs 37 of the U shaped member 24 includes a correspondingly located slot 40 in a surface area which faces the opposite leg 37. Within and between these slots 40 is slidably mounted a cross member 42 in the form of a plate 42 adapted to engage therebeneath one end of a tensioning spring 44, the other end of the spring 44 being slidably engaged along and upon the flange member 36 located therebeneath.

The spring 44 is fixedly engaged to the slidable plate 42 and slidably engaged to the flange member 36 to provide an adjustable level of tension against the plate member 42 which, in turn, translates to the horizontal top member 14.

In this respect, as the spring 44 is slid toward the vertical support 16 by moving plate 42, a decreased tension against the horizontal top member is created while positioning the spring 44 at points spaced from said vertical support 16 increases the tension relative to the distance from the vertical support 16. Stated otherwise, the greatest amount of tension is produced by the spring 44 when the spring 44 is positioned furthest from the vertical support 16.

Figure 3:
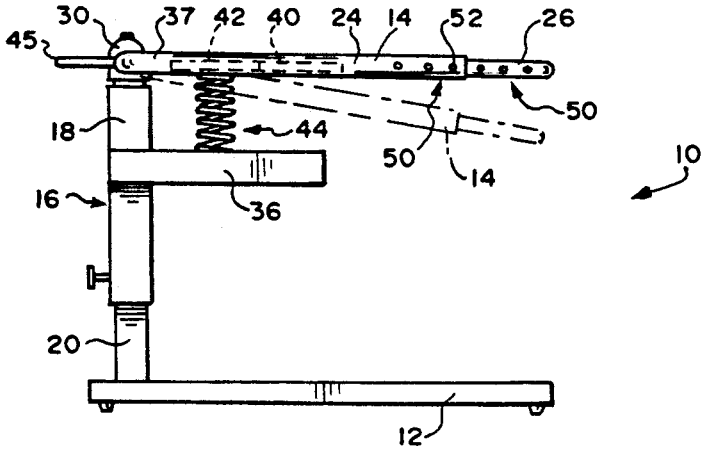
FIG. 3 is a side view of the apparatus showing a top horizontal member of the apparatus being pressed downwardly against biasing pressure supplied against the underside thereof by a biasing spring.
Figure 5:
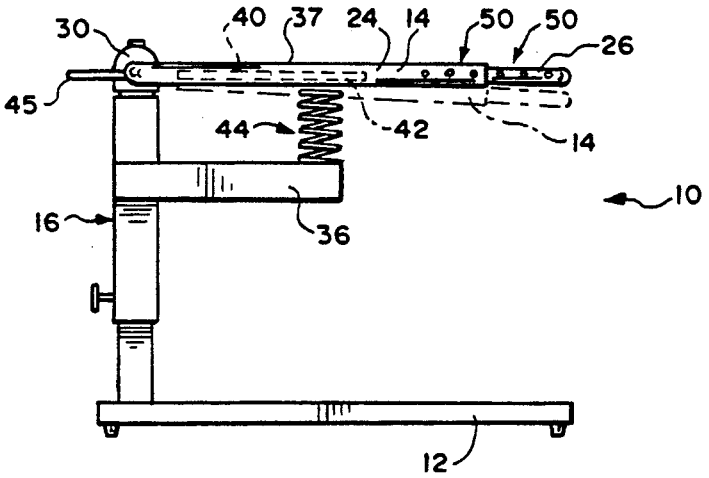
FIG. 5 is a side view of the apparatus showing a modified positioning of the spring to create a greater resistance against the top member.

This is easily understood inasmuch the degree to which the top member 14 pivots increases as the distance from the point of attachment to the vertical support 16 increases. This concept is best appreciated from a comparison of FIGS. 3 and 5.

Figure 6:
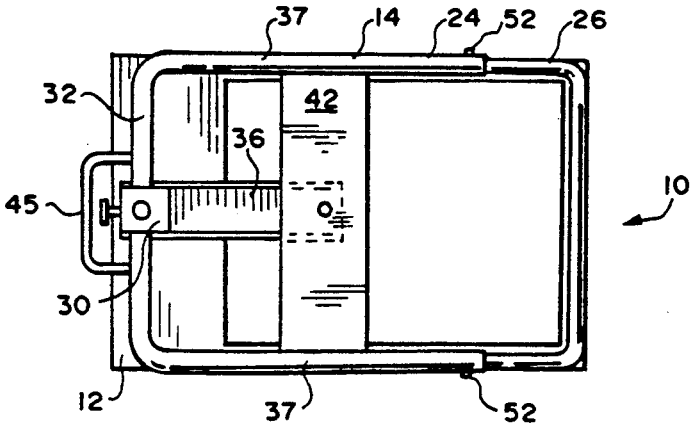
FIG. 6 is a top plan view showing the spring positioned as in FIG. 5.

Returning to a study of the top member 14, the base of the U shaped member 24 attached to the vertical support 16 includes an outwardly disposed rail 45 which, as shown in FIG. 6 is grasped by a user when the user stands alongside the apparatus 10. This rail 45 provides a graspable support 45 for one hand of the user while the user does side bends, thereby forcing the free end of the top member 14 downwardly with the other hand.

Figure 4:
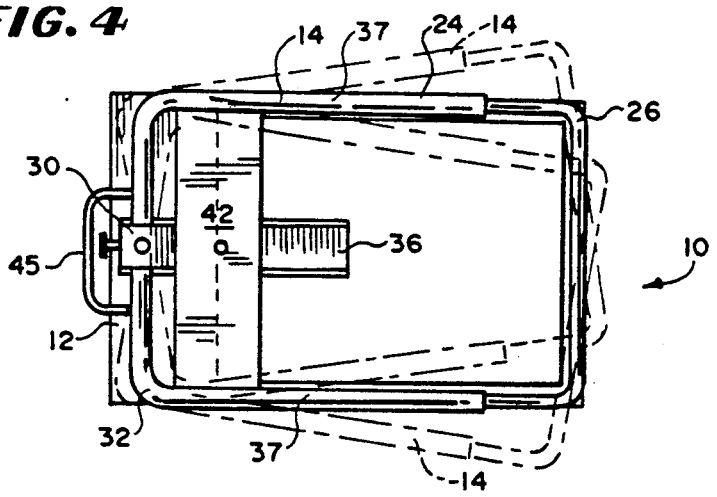
FIG. 4 is a top view of the apparatus showing the top member thereof horizontally pivoted to either side of center, in phantom.

To make this exercise for the lateral abdominals more complex, the top member 14 can be horizontally pivoted toward or away from the user, as shown in FIG. 4, to cause a torque action about the midline of the user in conjunction with the side bend, creating a higher degree of difficulty, suitable for an advanced user of the apparatus 10.

Further, the legs 37, toward the free ends of each U shaped member 24 include lines of openings 50 therethrough which align with the lines of openings 50 on the free ends of the other U shaped member 24. In this manner, as the free ends are slidably engaged to one another, pins 52 may be placed within these openings 50 once they are aligned to lock the U shaped members 24 together in a manner allowing for the length of the top member 14 to be adjustable. The adjustability of the length is an important factor inasmuch as each person's distance of reach is different.

FIG. 7 shows a user positioned at a free end 60 of top member 14 as it is proposed for use in exercising the midline abdominals and to a lesser extent, the lower back muscles. In this use of the apparatus 10 the user applies a direct, downward pressure onto the free end of the top member 14, thus using the midline abdominal muscles and, to a lesser extent the lower back muscles.

Here again, by appropriate positioning of the spring 44, tension against downward movement of the top member 14 can be increased or decreased, as desired Further, by horizontally pivoting the top member 14 from its primary position, once again, a torque action may be added to increase the level of difficulty of the exercise.

As described above, the exercise apparatus 10 of the present invention has a number of advantages, some of which have been described above and others of which are inherent in the invention. Also, modifications may be proposed to the apparatus 10 without departing from the teachings herein.

Accordingly, the scope of the invention is only to be limited as necessitated by the accompanying claims.

I claim:

1. An exercising apparatus comprising:

a planar base member;

a radial Flange;

a vertical support member extending upwardly from said planar base member;

a downwardly pivotable horizontal planar top member supported by said vertical support member above the planar base member; which includes a slidable panel engaged thereto between lateral peripheries thereof, said panel being slidable toward and away from the vertical support member, said radial flange being attached to said vertical support member, and extending under said top member a substantial distance above the base member wherein said radial flange includes a slide mechanism on a top surface thereof and a tensioning means being slidably engaged to one end thereof to said slide member on said radial flange and at the other end thereof and at the other end thereof being engaged in a fixed manner to the slidable panel of said top member.

2. The apparatus of claim 1 wherein said vertical support member includes two telescoping sections.

3. The apparatus of claim 2 wherein a top telescoping section includes a horizontally pivotable head portion to which said top member is engaged.

4. The apparatus of claim 3 wherein said tensioning means comprises a tensioning spring.

5. The apparatus of claim 3 wherein said top member comprises a rectangular tubular structure.

6. The apparatus of claim 5 wherein said tubular structure is formed of two U shaped members with free ends of one of said members being slidably engageable within free ends of the other one of said members.

7. The apparatus of claim 6 wherein said U shaped members are engaged to one another by pins which extend through aligned lines of openings in the free ends of the U shaped members once they have been joined to one another, to provide a variable length to said top member.

8. The apparatus of claim 7 including an outwardly protruding graspable handle on one end of said top member.

9. The apparatus of claim 8 wherein said handle protrudes from an end of said top member engaged to said vertical support, member outwardly of said vertical support member.

10. The apparatus of claim 9 wherein the height of the top member is adjustable relative to the base by manipulation of said telescoping vertical support members.

11. The apparatus of claim 10 wherein said support members are lockable in a chosen position.

* * * * *